US005307982A

United States Patent [19]

Swindell

[11] Patent Number: 5,307,982

[45] Date of Patent: May 3, 1994

[54] LEAK-RESISTANT CORRUGATED PAPERBOARD CONTAINER WITH EXTERIOR HAND GRIPS

[75] Inventor: James F. Swindell, Athens, Ga.

[73] Assignee: Coolers Unlimited, Inc., Hinesville, Ga.

[21] Appl. No.: 991,329

[22] Filed: Dec. 16, 1992

[51] Int. Cl.[5] ..... B65D 5/24; B65D 5/46

[52] U.S. Cl. ..... 229/172; 229/117.19; 229/117.25; 229/186

[58] Field of Search ..... 229/117.19, 117.24, 229/117.25, 117.26, 151, 152, 153, 160, 172, 173, 186

[56] References Cited

U.S. PATENT DOCUMENTS

| | | | |
|---|---|---|---|
| 887,352 | 5/1908 | Sommer | 229/152 |
| 998,497 | 7/1911 | Goodyear | 229/186 |
| 1,446,250 | 2/1923 | Gibson et al. | 229/186 |
| 1,707,528 | 4/1929 | Bombard et al. | 229/117.26 |
| 1,758,510 | 5/1930 | Gross | 229/186 |
| 1,941,084 | 12/1933 | Gross | 229/173 |
| 1,941,775 | 1/1934 | Young | 229/117.25 |
| 2,151,472 | 3/1939 | Hubbard | 229/186 |
| 2,443,431 | 6/1948 | Ringler | 229/151 |
| 2,612,401 | 9/1952 | Simmonds | 229/117.19 |
| 2,754,046 | 7/1956 | Roberts | 229/186 |
| 2,938,656 | 5/1960 | Bertram | 229/117.25 |
| 3,269,638 | 8/1966 | Forbes | 229/152 |
| 3,531,041 | 9/1970 | Rohde | 229/186 |

FOREIGN PATENT DOCUMENTS

| | | | |
|---|---|---|---|
| 1270568 | 7/1961 | France | 229/151 |

OTHER PUBLICATIONS

The Wiley Encyclopedia of Packaging Technology, John Wiley & Sons, 1986, pp. 697, 699.

*Primary Examiner*—Gary E. Elkins
*Attorney, Agent, or Firm*—Kennedy & Kennedy

[57] ABSTRACT

A container foldably assembled from a single blank of treated corrugated paperboard for carrying iced canned or bottled beverages and food, with hand grips exterior of the container defined by a hole in each corner panel that folds against the end panels of the container. A hook at each end of a strap engages a respective hand grip for carrying the container on the shoulder of a person using the container.

20 Claims, 2 Drawing Sheets

LEAK-RESISTANT CORRUGATED PAPERBOARD CONTAINER WITH EXTERIOR HAND GRIPS

TECHNICAL FIELD

The present invention relates to containers for carrying iced canned or bottled beverages and foods. More particularly, the present invention relates to a container foldably assembled from a single blank of corrugated paperboard with exterior hand grips for carrying the container.

BACKGROUND OF THE INVENTION

Small containers of various construction have been used for maintaining a cold atmosphere for canned or bottled beverages and foods. Such containers are known as coolers, and are typically used at picnics, parties, tail-gate parties, travel, beach outings, and the like. The coolers are partially filled with ice or a cold-inducing package that is known in the art. The beverages and foods are then placed in the container for being kept cool. A lid closes the cooler.

A coolers loaded with ice, beverages, and food is heavy. Coolers accordingly are typically sized for convenient carrying, such as by a single individual or by two or more persons holding the ends of the cooler. Often the coolers include a handle or hand grip at the ends of the cooler to facilitate carrying. For example, some known coolers are made of a metal skin and plastic inner liner that sandwich a thermally insulative barrier. Such coolers often include a U-shape pivotable handle on each longitudinal end for carrying the cooler. Other coolers are sized for carrying six canned beverages. These coolers typically have plastic walls and a pivotable top for closing the cooler. A handle in these known coolers is molded into the top.

The coolers discussed above are of a type and quality that they are kept for re-use. In some instances however, low cost, disposable coolers are preferred for use. One such inexpensive cooler is made from molded styrofoam, and is typically available in several sizes. The ends in some known styrofoam coolers have wedge-shaped built-up sections on the end walls for hand grips.

Other low cost cartons for foods are known. For instance, U.S. Pat. No. 3,904,106 describes a carton formed from a single piece of corrugated paperboard called a blank. A plurality of scores in the blank define several panels that form the walls, bottom, and top of the carton. A corner connector panel attaches to a side and end panels, and a diagonal score divides the corner connector into first and second triangular sections. A locking panel attaches to one of the triangular sections at each end of the blank. A tab extends outwardly from the locking panel for insertion into a slot in a bottom panel. The carton assembles by folding the triangular sections into face contact and sandwiching the first triangular section between an end panel and the second triangular section. The locking panel extends over the upper edge of the first triangular section and into the carton. The tab inserts into the slot in the bottom panel to maintain the carton in its erected position. One embodiment of the carton in the ,106 patent includes a handle cut-out in each end wall. The corner panels in this embodiment each require a separate tab and slot to maintain the carton in its erected position.

While accomplishing the goal of providing a container, the above-discussed low-cost containers still have drawbacks for use as a cooler for iced beverages and foods. The carton described in the '106 patent is not useable as a cooler for iced beverages and foods. First, the carton is not easily carried as an individual container. A single carton would be held and carried awkwardly from the bottom. Second, the carton also requires at least one slot in the bottom panel for securing the tab on the locking panel to hold the carton in its erected position. The slots allow water from the melted ice to flow out of the container. A person would thereby get wet by carrying the carton. The water would leak out into cars, stores, and other places where the container is being used. Third, the cut-out in the end panel (and the slots) create thermal leak paths into the carton. These reduce significantly the thermal insulative performance of the carton. Such cartons are suitable for use in refrigerated storage rooms, but are not desirable for use as a cooler for picnics, parties, and the like.

Styrofoam, while providing a low cost container, also has drawbacks which limit its suitability for use as a cooler. The hand grips are difficult to grasp and a loaded styrofoam cooler is awkward to carry. Styrofoam is brittle, and the walls easily break under load. Although styrofoam provides insulative characteristics, the beads of styrofoam in the walls of the container define interstices through which fluids and thermal energy may pass. Molded styrofoam coolers are necessarily formed in the completed shape, as are the metal coolers discussed above. A stack of such coolers occupies display and floor space, such as at the retail outlet selling the cooler. Finally, the lid for a styrofoam cooler typically is a separate piece which may break or become lost from the cooler.

Therefore, there is a need in the art for a leakresistant, easily assembled container with hand grips exterior of the walls of the container for carrying iced canned or bottled beverages and foods.

SUMMARY OF THE PRESENT INVENTION

Generally described, the present invention provides a container that includes hand grips exterior of the walls for carrying the container. The container is formed from a single sheet of corrugated paperboard having a bottom panel, two end panels and two side panels. At least one corner panel foldably attaches to each end panel of the container and has a hole therein for a hand grip exterior of the walls of the container when assembled.

More particularly described, the container comprises a single sheet of corrugated paperboard treated with a wax and polyethylene film as a moisture barrier. The container includes a bottom panel with two side panels and two end panels each foldably joined along a respective score defining an edge of the bottom panel. A corner panel foldably joins adjacent end and side panels along a respective score therewith and has a hole therein. A foldable score extends diagonally from an outer corner of the corner panel to the bottom panel to define a pair of triangular sections in the corner panel. Each corner panel folds on the diagonal score into a triangular wing which, being folded against the end panels, then positions the holes for hand grips exterior of the end panels for carrying the container.

More particularly described, the container is held in the assembled position by an inside end panel foldably attached to one of the corner panels on each end of the container. The inside end panel folds inwardly over the corner panels into the container and against the inside surface of the end panel. A flange on the inside end panel is thereby brought firmly into contact with the bottom panel. The inside end panels hold each end of the folded assembled container.

More particularly described, the hand grip may receive a J-hook which connects to a strap for carrying the container.

Accordingly, it is an object of the present invention to provide a hand grip exterior to a leak-resistant container.

It is another object of the present invention to provide a hand grip in a container formed by folding a single piece of corrugated paperboard.

It is another object of the present invention to provide a hand grip for a container, which receives a hook from a strap for carrying the container.

It is another object of the present invention to provide a container that is shipped and stored flat prior to assembly for use as a cooler with iced beverages and foods.

These and other objectives, features, and advantages will become apparent from a reading of the following detailed description of the invention and claims in view of the appended drawings.

DETAILED DESCRIPTION

Figure 1:
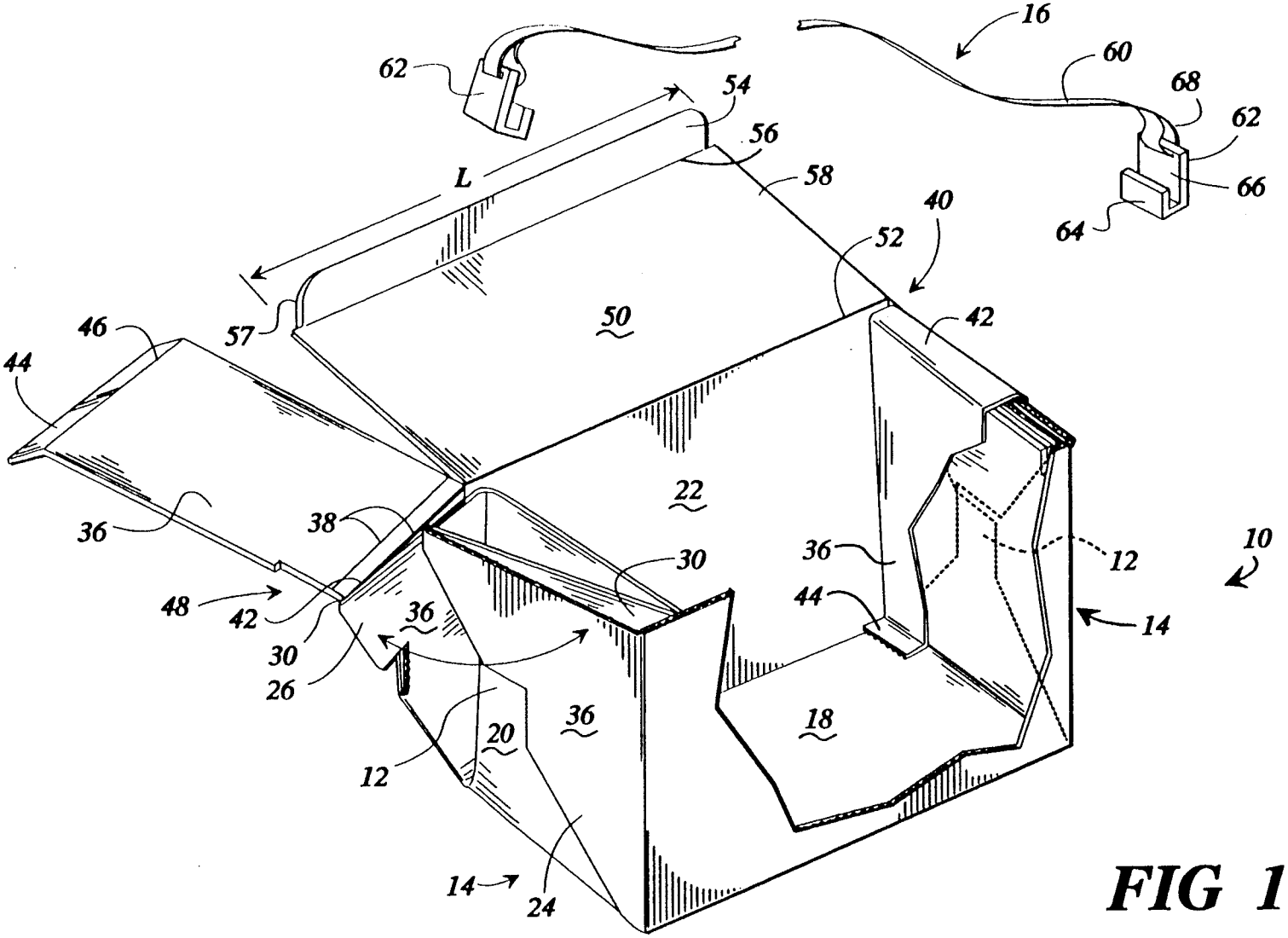
FIG. 1 is an upper and right perspective view of a container having hand grips exterior of the ends thereof, constructed in accordance with the present invention, with a strap for carrying the container exploded therefrom.

Referring now in more detail to the drawings, in which like numerals indicate like parts throughout the several views, FIG. 1 shows an upper and right perspective view of a container 10 constructed in accordance with the present invention, having hand grips generally designated 12 on the ends 14 thereof for holding and carrying the container. The illustrated embodiment of the container 10 includes a strap 16 exploded therefrom, which may also be used for carrying the container. The container 10 includes a bottom panel 18, two end panels 20 and two side panels 22. Each end 14 includes a first corner panel 24 and a second corner panel 26. As discussed below, the corner panels 24 and 26 foldably attach to edges of a pair of adjacent end panel 20 and side panel 22. The corner panels 24 and 26 fold along an interior score 28 (best shown in FIG. 2) to define triangular wings 30 which overlap outside the respective end panel 20. The corner panels 24 and 26 each include a hole 32 (best shown in FIG. 2). The holes 32 form the hand grips 12 in the triangular wings 30. The present invention positions the hand grips 12 exterior of the end panels 20 which define end walls of the container 10, so there is no opening through the wall of the container.

An inside end panel 36 foldably attaches with a pair of spaced apart scores 38 to each of the second corner panels 26 on a first side 40 of the container 10. The scores 38 in each inside end panel 36 define a cover panel 42. The cover panel 42 covers the upper edges of the folded triangular wings 30, as illustrated in FIG. 1. A flap 44 foldably attaches by a score 46 to one edge of the inside end panel 36. When the container 10 is folded together, the flap 44 is brought firmly into contact with the bottom panel 18, as illustrated in cut-away view, for a purpose discussed below. A notch 48 extends from the corner panel 26 along a portion of the edge of the inside end panel 36, for a purpose discussed below.

A top panel 50 foldably attaches along a score 52 to the side panel 22 on the first side 40 of the container 10. A tab 54 foldably attaches to the top panel 50 along a score 56. In the illustrated embodiment, the tab 54 extends substantially the length L of the top panel 50 with a gap 57 at each end. This defines a lip 58 on each of the longitudinal ends of the top panel 50, for a purpose discussed below.

The strap 16 comprises an elongate ribbon 60 having a J-shaped hook 62 attached at each distal end. The hooks 62 each have an interior lip 64 which is received in the hand grip 12 between the end panel 20 and the folded triangular wings 30 for carrying the container 10, as discussed below. The hooks 62 each have an exterior arm 66 which attaches in a conventional manner to the ribbon 60, such as with a ring 68, clip, or the like. The ribbon 60 can be made of a fabric or plastic fiber material.

Figure 2:
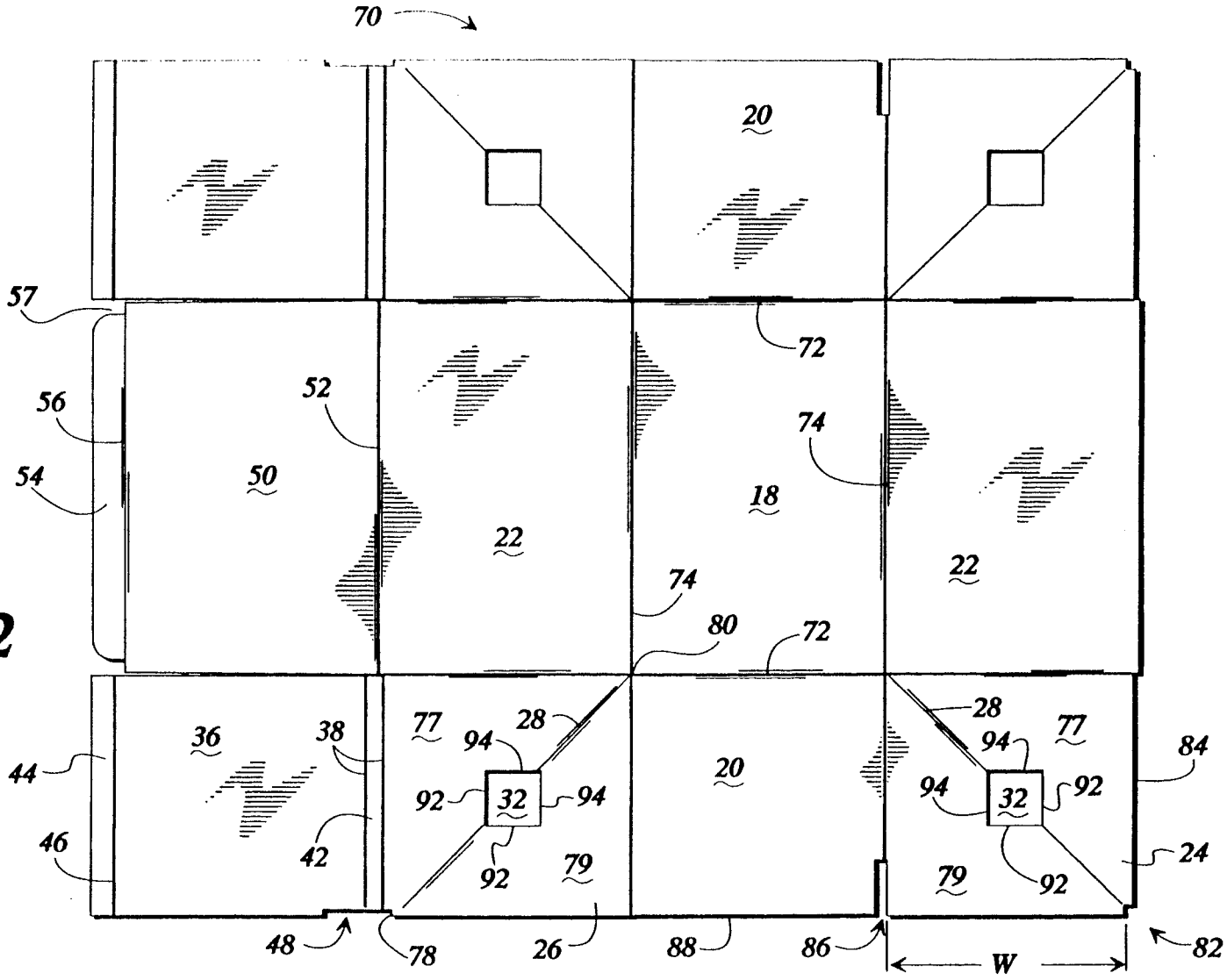
FIG. 2 is a plan view of a blank of corrugated paperboard for folding on scores to form the container illustrated in FIG. 1.

FIG. 2 illustrates a plan view of a blank 70 of corrugated paperboard for folding on scores to form the container 10 illustrated in FIG. 1. The blank 70 includes the bottom panel 18 with two end panels 20 and two side panels 22 foldably attached to the edges thereof by scores 72 and 74. The edges of a pair of adjacent side panel 22 and end panel 20 are connected by the corner panel 24 and the corner panel 26 on respective sides of the container 10. The corner panels 24 and 26 fold along the scores 72 and 74 which extend edge-to-edge longitudinally and laterally across the blank 70.

Each corner panel 24 and 26 includes a diagonal score 28 that extends from a corner 78 to the edge of the bottom panel 18 at the respective intersections 80 of the scores 72 and 74. The diagonal score 28 divides the corner panels 24 and 26 into a pair of triangular sections 77 and 79. The triangular sections 77 and 79 fold on the score 28 to form the triangular wing 30 (shown in FIG. 1.) In the illustrated embodiment, the corners 78 each have a rectangular notch 82 which facilitates folding the corner panels 24 and 26 along the score 28. The width W of the corner panels 24 and 26, for example, from the score 74 and an edge 84, is preferably less than that of the side panels 22, thereby facilitating folding the blank 70 to form the container 10, as discussed below. A slot 86 aligned with the score 74 extends inwardly from an edge 88 between the corner panel 24 and the end panel 20, for a purpose discussed below.

The corner panels 24 and 26 each include a hole 32. The holes 32 in respective corner panels 24 and 26 cooperate to form the hand grip 12 when the blank 70 is folded to form the container 10. In the illustrated embodiment, the holes 32 are square. The holes 32 in the illustrated embodiment are symmetrical about the diagonal score 28. In an alternate embodiment (not illustrated), the holes are non-symmetrical about the diagonally score 28. A pair of first sides 92 in the hole 32 define the upper edge of the hand grip 12; the pair of second sides 94 define the side edge of the hand grip 12. In an alternate embodiment (not illustrated) the first sides 92 define arcs, so that the upper edge of the resulting hand grip is curved. In an alternate embodiment, the holes 32 are rectangular with the first sides 92 longer than the second sides 94. This results in a relatively wide hand grip 12.

In the illustrated embodiment, the holes 32 are positioned near the center of each of the corner panels 24 and 26. When the blank 70 is folded, the hand grip 12 defined by the holes 32 are thereby positioned just below the longitudinal axis of the container 10. This facilities balancing the container 10 for carrying. In an alternate embodiment (not illustrated), the holes 32 are positioned so that the hand grips 12 are closer to the top of the container 10.

The inside end panel 36 attaches along the pair of spaced-apart scores 38 to the corner panel 26. The parallel scores define the cover panel 42. The flange 44 foldably attaches to the inside end panel 36 along the score 46. The notch 48 extends along a portion of the edge of the inside end panel 36 from the inner score 38 towards the flange 44, for a purpose discussed below.

The top panel 50 attaches to the side wall 20 on the first side 40 along a score 52. The tab 54 foldably attaches along the score 56 to the top panel 50.

The blank 70 is preferably made of a single flute corrugated paperboard comprising a 42 pound outer liner, a 33 pound medium having flutes, and a 56 pound inner liner. Such corrugated paperboard is commonly known in the industry. The blank 70 is formed by passing the liners and medium through a corrugator which glues the liners and the medium together, preferably with a waterproof adhesive. In a preferred embodiment, the medium is wax impregnated before the corrugator adheres the three layers together.

The blank 70 is then die-cut. This step in the manufacturing process prints the graphics (if any) on the blank, cuts the holes 32, and cuts the scores.

A film of wax and polyethylene is then applied to the planar surfaces of the blank. This process is known in the industry as curtain coating. The coated film is a moisture barrier that makes the corrugated paperboard water resistant. In industry trade terminology, this corrugated paperboard is known as leak-proof board. The wax in the curtain coat and on the flutes in the medium form the moisture barrier which resists fluid transfer through the board 70 comprising the walls and bottom of the container 10. The boards 70 are in a knock-down position, and are readily shipped from the manufacturing plant to distribution and sales facilities.

To use the container 10 of the present invention, the blank 70 is folded on the scores 74 to raise the side panels 22 perpendicular to the bottom panels 18. The end panels 20 are then raised by folding upwardly along the scores 72. As the side panels 22 are raised, the corner panels are folded along the scores 28 to form the triangular wings 30. The corner panel 24 in its folded triangular shape is then folded along the score 74 against the end panel 20. The corner panel 26 in its folded triangular shape is then folded along its respective score 74 against the corner panel 24. The holes 32 are thereby aligned on the end 14 of the container 10. The holes 32 form the hand grip 12 exterior of the container 10, as shown in FIG. 1.

The inside end panel 36 is folded on the scores 38 with the cover panel 42 extending over the upper edges of the corner panels 24 and 26. The reduced width of the corner panels provides a gap for receiving the cover panel 42. The inside end panel 36 folds inwardly of the container 10 and against the inside surface of the end panel 20. The flange 44 is folded along the score 46 to firmly contact the bottom panel 18 as the inside end panel 36 is positioned against the end panel 20. The inside end panel 36 and the flange 44 against the bottom panel 20 cooperate to lock the corner panels 24 and 26 against the end panel 18. The corner panels 24 and 26 on the second end 14 of the container are like-wise folded along the scores and against the end panel, as illustrated in FIG. 1.

The top panel 50 folds along the score 52 towards the opposite side of the container 10 to close the open interior of the container. The tab 54 inserts inwardly of the opposite side 20 and is gripped in the notch 48 and the slot 80 which together form a slot at each end 14 of the container 10. The notch 48 and the slot 80 hold the tab 54 in order to hold the top panel 50 closed. The lip 58 on lateral sides of the top panel 50 extend outwardly over the cover panel 42.

The container 10 can then be opened and filled with ice and canned or bottled beverages and food, for use as a cooler. The ice keeps the beverages and food cold. The curtain coating of the blank 70 resists moisture penetration through the walls of the container 10. The walls have no openings through which fluid can flow and which reduce the thermal efficiency of the container 10. The hand grips 12 are exterior of the walls of the container 10, and are grasped by the hand of a user to carry the cooler.

In the illustrated embodiment, a strap 16 is provided for carrying the container "over the shoulder" of the user. The J-hooks 62 are engaged with the hand grips 12 by sliding the interior lip 64 between the end panel 20 and the corner panels 24 and 26 so the upper edge of the hand grip 12 catches on the hook. The exterior arm 66 is outside the corner panel 26, and the container 10 can then be carried by looping the strap 60 over the shoulder of the user.

The specification has thus described various embodiments, including a preferred embodiment, of the present invention, including the assembly and use thereof. It is to be understood, however, that numerous changes and variations may be made in the construction of the present invention. It should therefore be further understood that modification of the present invention may be made without departing from the scope thereof as set forth in the appended claims.

What is claimed is:

1. A container assembled from a single piece of corrugated paperboard blank, comprising:

a bottom panel with two side panels and two end panels that foldably extend upwardly from scores that define edges of the bottom panel;

four corner panels, each foldably joined on a first edge to a separate one of the end panels and along a second edge to the adjacent side panel, each corner panel including a hole and a foldable score extending diagonally from an outer corner of the corner panel to the bottom panel to define a pair of triangular sections, the corner panels folding along the respective diagonal scores and then folding overlappingly towards the respective end panel for aligning the holes in the two corner panels at each end to define hand grips for carrying the container, a pair of inside end panels, each attached on a first side of the blank to an outside edge of one of the triangular sections by a pair of spaced apart scores that define a panel for overlapping an upper edge of the folded corner panels; and a flap foldably attached to a distal edge of the inside end panel, whereby the panel for overlapping covers the upper edge of the folded corner panels by folding the inside end panel inwardly of the end panel thereby positioning the flap in firm contact with the bottom panel for holding the corner panels together.

2. The container as recited in claim 1, wherein the hole in each of the corner panels is symmetric about the diagonal score.

3. The container as recited in claim 1, wherein the hole is rectangular.

4. The container as recited in claim 3, wherein the hole is symmetric about the diagonal score.

5. The container as recited in claim 1, further comprising a top panel foldably attached to one of the side panels for closing the container.

6. The container as recited in claim 5, further comprising means for securing the top panel in a closed position.

7. The container as recited in claim 6, wherein means for securing comprises a flap foldably attached to the top panel for inserting inwardly of the opposite side wall.

8. The container as recited in claim 7, further comprising a notch along a portion of an outside edge of each inside end panel, whereby the flap on the top panel, being foldably inserted against the opposite sidewall, engages the notches.

9. The container as recited in claim 1, wherein the blank is coated with a moisture barrier.

10. The container as recited in claim 9, wherein the moisture barrier is a film of wax and polyethylene.

11. The container as recited in claim 1, further comprising a strap having a pair of J-shaped hooks attached at a first and a second distal end of the strap, whereby the J-shaped hooks, being recited in a respective one of the holes, matingly engages the container for carrying.

12. A container assembled from a single piece of corrugated paperboard blank, comprising:

a bottom panel with two side panels and two end panels that foldably extend upwardly from scores that define edges of the bottom panel;

four corner panels, each foldably joined on a first edge to a separate one of the end panels and along a second edge to the adjacent side panel, each corner panel including a hole and a foldable score extending diagonally from an outer corner of the corner panel to the bottom panel to define a pair of triangular sections, the corner panels folding along the respective diagonal scores and then folding towards the respective end panel for aligning the holes in the two corner panels at each end to define hand grips for carrying the container;

a pair of inside end panels, each attached on a first side of the blank to an outside edge of one of the triangular sections by a pair of spaced apart scores that define a panel for overlapping an upper edge of the folded corner panels; and a flap foldably attached to a distal edge of the inside end panel, a top panel foldably attached to an edge of the side panel on the second side of the blank for closing the folded container;

a closing flap foldably attached to an edge of the top panel for inserting inwardly into the folded container adjacent the first side wall and being grippingly engaged by the notches in the inside end panels, whereby the container forms by folding the side panels and the end panels upwardly, folding the corner panels on the respective diagonal score and rotating inwardly and overlappingly against the respective end panel, folding the inside end panels inwardly over an upper edge of the folded corner panels and end panels thereby positioning the flap on the inside end panels in firm contact with the bottom panel, and folding the top panel to the second side for engaging the closing flap with the notches for closing the container.

13. A container for holding a plurality of ice and canned beverages, comprising:

a corrugated paperboard blank having a first surface covered by a film and a second surface covered by a wax for insulating the container and reducing fluid leakage through the blank, the blank foldable along scores to define a bottom panel with two side panels and two end panels extending upwardly therefrom, each side panel and adjacent end panel foldably joined along scores at respective outer edges to a corner panel, each corner panel including a hole and a diagonal score extending from an outside corner to the bottom panel to define a first and a second triangular section, each of the two corner panels attached to one of the side panels has an inside end panel foldably attached along two spaced apart scores to an edge of the second triangular section and a flap foldably attached to an outside edge of each the inside panel, a top panel foldably attached to a second one of the side panels, and a flange foldably attached to the outside edge of the top panel, whereby the side panels and end panels fold upwardly and the corner panels fold first along their respective diagonal score into a triangular shape and second along the score with the side panel against the end panel, thereby aligning the holes in the two corner panels at each end to define hand grips for carrying the container.

14. The container as recited in claim 13, wherein the outside corner of the corner panel includes a square-cut notch for facilitating folding the corner panel along the diagonal score.

15. The container as recited in claim 13, wherein the hole in the corner panel is symmetrical about the diagonal score.

16. The container as recited in claim 13, wherein the hole in the corner panel is rectangular.

17. The container as recited in claim 13, further comprising a rectangular notch in a portion of an outside edge of each of t he inside end panels.

18. The container as recited in claim 17, wherein the flange has a length less than the length of the top panel to define a pair of side lips in the top panel that each overlay a respective one of the inside end panels when the blank is folded to form the container.

19. The container as recited in claim 13, further comprising a strap having a pair of J-shaped hooks attached at a first and a second distal end of the strap, whereby the J-shaped hooks, being received in a respective one of the holes, matingly engages the container for carrying.

20. The container as recited in claim 13, wherein the blank is coated with a film of wax and polyethylene as a moisture barrier.

* * * * *

UNITED STATES PATENT AND TRADEMARK OFFICE

CERTIFICATE OF CORRECTION

PATENT NO. : 5,307,982

DATED : May 3, 1994

INVENTOR(S) : James F. Swindell

It is certified that error appears in the above-indentified patent and that said Letters Patent is hereby corrected as shown below:

At column 7, line 58, after "panels" insert --, each inside end panel including a notch in a portion of an outside edge near the pair of scores--.

Signed and Sealed this

Thirtieth Day of May, 1995

*Attest:*

*Attesting Officer*

BRUCE LEHMAN

*Commissioner of Patents and Trademarks*